US010221705B2

(12) United States Patent
Benson

(10) Patent No.: US 10,221,705 B2
(45) Date of Patent: Mar. 5, 2019

(54) SLIDER FOR CHOCKING A DOVETAIL ROOT OF A BLADE OF A GAS TURBINE ENGINE

(71) Applicant: ROLLS-ROYCE PLC, London (GB)

(72) Inventor: Christopher Benson, Derby (GB)

(73) Assignee: ROLLS-ROYCE plc, London (GB)

( * ) Notice: Subject to any disclaimer, the term of this patent is extended or adjusted under 35 U.S.C. 154(b) by 511 days.

(21) Appl. No.: 14/856,958

(22) Filed: Sep. 17, 2015

(65) Prior Publication Data

US 2016/0097289 A1 Apr. 7, 2016

(30) Foreign Application Priority Data

Oct. 2, 2014 (GB) ..... 1417417.1

(51) Int. Cl.
*F01D 5/32* (2006.01)
*F01D 5/30* (2006.01)

(52) U.S. Cl.
CPC ..... *F01D 5/326* (2013.01); *F01D 5/30* (2013.01); *F01D 5/3007* (2013.01); *F01D 5/3092* (2013.01); *F01D 5/323* (2013.01)

(58) Field of Classification Search
CPC . F01D 5/326; F01D 5/323; F01D 5/30; F01D 5/3007; F01D 5/3092
See application file for complete search history.

(56) References Cited

U.S. PATENT DOCUMENTS 3,378,230 A * 4/1968 Toomey ..... F01D 5/3007 416/219 R
4,022,545 A * 5/1977 Shank ..... F01D 5/26 416/135
4,836,749 A * 6/1989 Gavilan ..... F01D 5/3046 416/218
5,123,813 A * 6/1992 Przytulski ..... F01D 5/26 403/372
5,236,309 A * 8/1993 Van Heusden ..... F01D 5/323 416/206
5,820,347 A * 10/1998 Bussonnet ..... F01D 5/323 416/221

(Continued)

FOREIGN PATENT DOCUMENTS

FR 2 841 609 A1 1/2004
WO 2014/105104 A1 7/2014

OTHER PUBLICATIONS

Mar. 7, 2016 extended Search Report issued in European Patent Application No. 15185413.0.

(Continued)

*Primary Examiner* — Eldon T Brockman
(74) *Attorney, Agent, or Firm* — Oliff PLC

(57) ABSTRACT

A slider for chocking a dovetail root of a blade of a gas turbine engine in a corresponding axially-extending slot in the rim of a disc. The slider, in use, is slidingly inserted in an axially-extending cavity formed in the base of the root and in the disc at the base of the slot to urge the blade radially outwardly and thereby mate flanks of the root to flanks of the slot. The slider is arc-shaped and the cavity is correspondingly arc-shaped. The normal to the plane of the arc of the arc-shaped cavity is substantially perpendicular to the engine axis such that, when inserted in the cavity, the slider also retains the root axially in the slot.

18 Claims, 3 Drawing Sheets

(56) References Cited

U.S. PATENT DOCUMENTS 6,447,253 B2 * 9/2002 Tempere ..... F01D 5/3007 416/221
6,634,863 B1 10/2003 Forrester et al.
6,761,538 B2 * 7/2004 Fitts ..... F01D 5/3038 416/221
6,837,686 B2 * 1/2005 Di Paola ..... F01D 5/323 416/220 R
7,108,484 B2 * 9/2006 Thenaisie ..... F01D 5/323 416/221
8,186,961 B2 * 5/2012 Stone ..... F01D 5/3092 416/221
8,826,536 B2 * 9/2014 Stone ..... F01D 5/3092 29/889.21
8,851,854 B2 * 10/2014 Alexander ..... F01D 5/3092 416/221
8,870,545 B2 * 10/2014 Reghezza ..... F01D 5/3007 416/220 R
9,297,272 B2 * 3/2016 Drozdenko ..... F01D 21/14
9,410,440 B2 * 8/2016 Dimelow ..... F01D 5/303
9,422,819 B2 * 8/2016 Drozdenko ..... F01D 5/3092
2005/0254951 A1 * 11/2005 Thenaisie ..... F01D 5/323 416/219 R
2009/0004017 A1 * 1/2009 Belmonte ..... F01D 5/3092 416/219 R
2010/0189564 A1 * 7/2010 Stone ..... F01D 5/3092 416/221
2012/0107125 A1 * 5/2012 Reghezza ..... F01D 5/3007 416/220 R
2013/0156591 A1 * 6/2013 Alexander ..... F01D 5/3092 416/221
2014/0023508 A1 * 1/2014 Dimelow ..... F01D 5/303 416/221

OTHER PUBLICATIONS

Mar. 18, 2015 Search Report issued in British Application No. 1417417.1.

* cited by examiner

Fig.(2b)

SLIDER FOR CHOCKING A DOVETAIL ROOT OF A BLADE OF A GAS TURBINE ENGINE

FIELD OF THE INVENTION

The present invention relates to a slider for chocking a dovetail root of a blade of a gas turbine engine in a corresponding dovetail slot in the rim of a disc.

BACKGROUND OF THE INVENTION

Many aero-engines adopt a dovetail style of fan blade root which locates in a corresponding slot formed in the rim of the fan disc. During service operation, the fan assembly is subject to a complex loading system, consisting of centripetal load, gas-bending and vibration. The dovetail geometry copes particularly well with this kind of loading conditions.

On assembly, the blades are "chocked" up to mate the flanks of the corresponding dovetail slots (in the absence of any centrifugal force when static) by inserting a slider beneath the blade root. When the rotor assembly is spinning, the blades are restrained radially by the dovetail slots, which are sized according to mechanical rules based on extreme load cases.

To prevent the blades moving axially forward or rearward a number of approaches can be employed. One is to use a solid block or plate of metal inserted into machined grooves in the disc either at the front and back of the dovetail slot or mid slot (which requires a corresponding groove machined into the blade root). This approach relies on the shear strength of the plates (and disc grooves) to withstand any axial force placed on them. The plates are sized on the worst case of either large bird impact or trailing blade impact following a fan blade off event.

The large forces seen during these extreme cases lead to a thick plate design and a correspondingly large extension of the disc. This requires larger and more expensive disc forging and increases the disc machining time. In addition, the extension: adds weight and therefore increases specific fuel consumption; can use up engine space and encroach on adjacent components; and can lead to pumping and windage, creating a secondary airflow and associated temperature increase. Further, the shear plate produces a larger part count, which increases costs and assembly time.

The mid slot approach requires machining of the blade root to accommodate the plate, which breaks through the dovetail flanks. This can be acceptable in the case of a metal blade, but may cause issues in a composite blade, where the groove in the blade root is typically perpendicular to the fibre plies in the root and has sharp edges, which may cause stress concentrations. Breaking the flanks can also require the blade root to be extended axially to meet acceptable crushing stress limits (which again lead to a corresponding increase in disc axial length).

Current blade retention approaches also offer little vibrational damping to the blade or disc.

SUMMARY OF THE INVENTION

In a first aspect, the present invention provides a slider for chocking a dovetail root of a blade of a gas turbine engine in a corresponding axially-extending slot in the rim of a disc, the slider, in use, being slidingly inserted in an axially-extending cavity formed in the base of the root and in the disc at the base of the slot to urge the blade radially outwardly and thereby mate flanks of the root to flanks of the slot;

wherein the slider is arc-shaped and the cavity is correspondingly arc-shaped with the normal to the plane of the arc of the arc-shaped cavity being substantially perpendicular to the engine axis such that, when inserted in the cavity, the slider also retains the root axially in the slot.

The slider provides a dual function of chocking and axial retention, and thus reduces part count. In addition, the slider can be retained within the forging envelope of the disc, and does not require any extension of the disc, saving on forging and machining costs and weight. Further, the slider is compatible with composite blades, not requiring any break in the flanks of the blade root. The cross sectional profile of the slider can be configured for bending strength, weight and vibrational response. Under extreme axial loading, impact energy can be dissipated through shear, bending and compressive forces between the slider, blade root and disc, rather than pure shear as with a conventional retaining plate.

In a second aspect, the present invention provides a rotor assembly of a gas turbine engine, the assembly having:

a disc;

a circumferential row of blades (e.g. composite blades), each blade having a dovetail root which is retained in a corresponding axially-extending slot in the rim of the disc; and a circumferential row of arc-shaped sliders according to the first aspect;

wherein each slider is slidingly inserted in an axially-extending and correspondingly arc-shaped cavity formed in a base of a respective root and in the disc at a base of the slot to urge that blade radially outwardly and thereby mate flanks of the root to flanks of the slot, the normal to the plane of the arc of the arc-shaped cavity being substantially perpendicular to the engine axis such that the slider also retains the root axially in the slot.

For example, the assembly can be a fan assembly, with the blades being fan blades, and the disc being a fan disc.

In a third aspect, the present invention provides a gas turbine engine having the rotor assembly of the second aspect.

Optional features of the invention will now be set out. These are applicable singly or in any combination with any aspect of the invention.

The slider may have a relatively compliant outer layer for enhanced contact of the slider with the root. Similarly, the slider may have a relatively compliant inner layer for enhanced contact of the slider with the disc. Thus, for example, the outer and/or inner layer can be formed of an elastomer. In contrast, the body of the slider can be relatively rigid (being formed e.g. of metal or composite material). The compliant layer(s) can provide damping, impact protection, and take up any tolerance between the root, rotor and slider.

The slider may have a low friction coating (formed e.g. of PTFE or polyimide) at the innermost and/or outermost surface thereof to facilitate its insertion into the cavity.

The slider may have a stop at an end thereof which, in use, abuts a face of the disc or the root when the slider is fully inserted in the cavity to prevent over-insertion of the slider. For example, the stop can be a flange which abuts an external face of the disc and/or the root. Another option is for the stop to be to be a locating feature which abuts a surface, such as a flat, provided by the disc or the root within the slot and/or the cavity.

The slider may contains one or more pockets filled with vibration damping material.

To enhance its chocking functionality, the slider may include one or more chock springs which are arranged to act, in use, on the disc at the base of the slot to urge the blade radially outwardly. For example, the chock spring(s) can be located to act on the disc at the base of the slot in the arc-shaped cavity. Another option is for the slider to have wings at lateral sides thereof, and for the chock springs to be located on the wings to act on the disc at the base of the slot on both sides of the arc-shaped cavity.

Generally, the dovetail root and slot are straight, but a curved root and slot are not precluded.

Conveniently, the normal to the plane of the arc of the arc-shaped cavity can be substantially perpendicular to the radial direction as well as substantially perpendicular to the engine axis.

The concave side of the arc-shaped cavity can face radially outwardly or radially inwardly.

BRIEF DESCRIPTION OF THE DRAWINGS

Embodiments of the invention will now be described by way of example with reference to the accompanying drawings in which:

FIG. 2(*b*) shows a view of the cavity, root and disc on direction Y parallel to the engine centre line;

FIG. 2(*c*) shows an alternative arrangement for the arc-shaped cavity on the cross-section containing the engine centre line;

FIG. 2(*d*) shows a view of the alternatively arranged cavity, root and disc on direction Y;

FIG. 5(*b*) shows possible cross-sectional shapes for the slider;

FIG. 7(*b*) shows a side view of a further variant of the slider having chock springs; and FIG. 7(*c*) shows a cross-section on plane D-D through the further variant in use.

DETAILED DESCRIPTION AND FURTHER OPTIONAL FEATURES OF THE INVENTION

Figure 1:
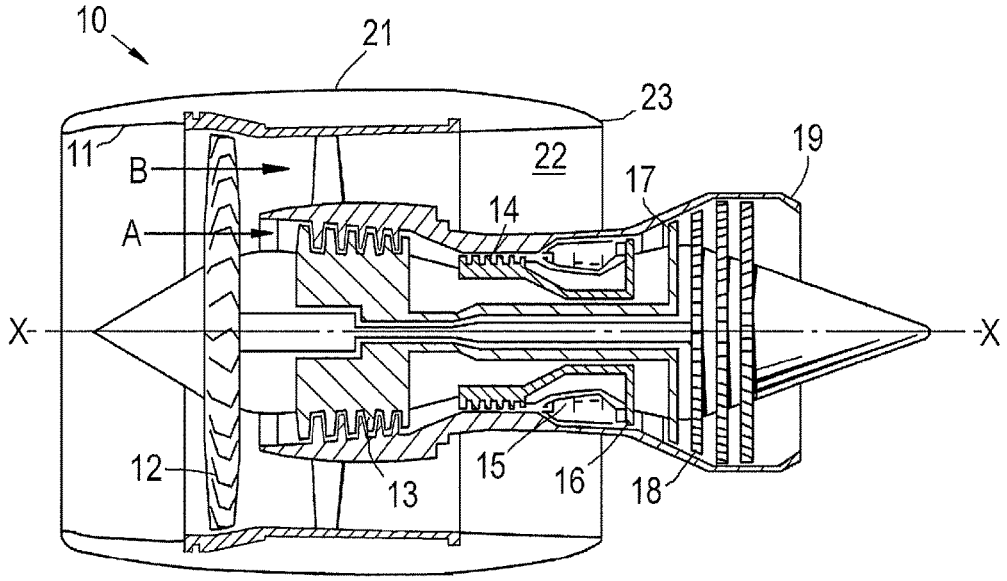
FIG. 1 shows a longitudinal cross-section through a ducted fan gas turbine engine.
Figure 2A:
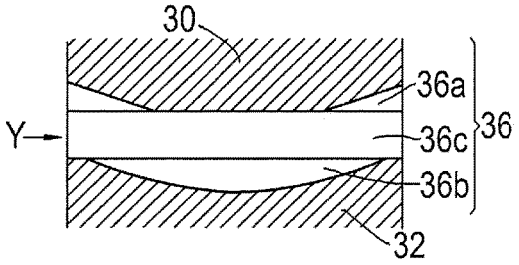
FIG. 2(*a*) shows an arc-shaped cavity for a slider on a cross-section, containing the engine centre line, of a blade dovetail root and a disc to which the root is mounted at a dovetail slot.
Figure 2C:
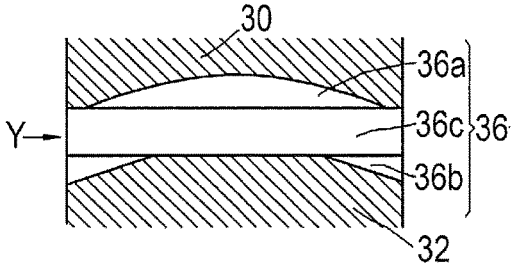
Figure 2C:
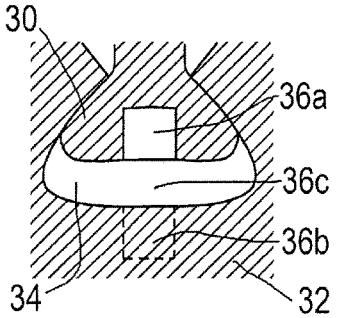
Figure 2D:
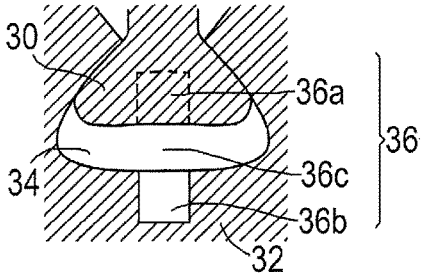

With reference to FIG. 1, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate-pressure compressor 13 and a second air flow B which passes through the bypass duct 22 to provide propulsive thrust. The intermediate-pressure compressor 13 compresses the air flow A directed into it before delivering that air to the high-pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate-pressure compressors 14, 13 and the fan 12 by suitable interconnecting shafts.

The fan 12 comprises a fan disc and a circumferential row of fan blades extending from the disc. Each blade has as a dovetail root which is retained in a corresponding axially-extending slot in the rim of the disc. To chock the flanks of roots radially outwardly against the flanks of the slots, and to retain the roots axially within the slots, each blade has a slider according to the present invention, and each combination of a root and a slot forms a cavity for the slider.

FIG. 2 shows (a) a cross-section containing the engine centre line of a blade root 30 and the disc 32, and (b) a view of the root and the disc on direction Y parallel to the engine centre line. An axially extending arc-shaped cavity 36 has upper portions 36*a* formed at the ends of the root 30, and a lower portion 36*b* formed in the disc 32 at the centre of the base of the dovetail slot 34. The remaining portion 36*c* of the cavity between the upper and lower portions is simply a part of the slot 34 between the upper and lower portions. The normal to the plane of the arc of the cavity 36 is perpendicular to the engine axis and typically also is perpendicular to the radial direction.

As shown in FIGS. 2(*a*) and (*b*), the concave side of the arc-shaped cavity 36 can face radially outwardly. However, an alternative arrangement for the cavity 36 has its concave side facing radially inwardly, as shown in FIGS. 2 (*c*) and (*d*), which are the corresponding sections for this alternative arrangement. In the alternative arrangement, the cavity 36 has lower portions 36*b* formed in the disc 32 at the ends of the base of the slot 34, and an upper portion 36*a* formed at the centre of the root 30.

Figure 3:
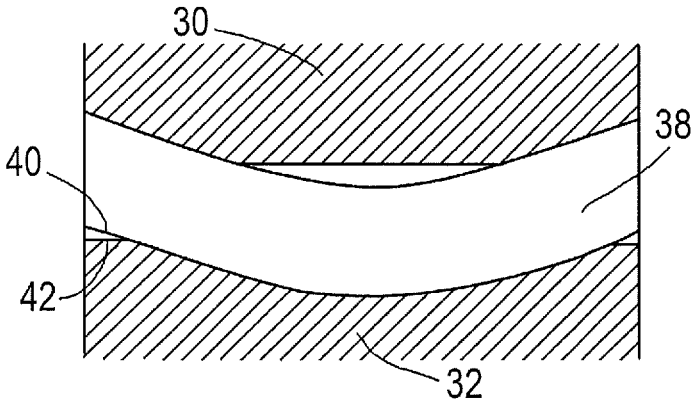
FIG. 3 shows the arrangement of FIGS. 2(*a*) and (*b*) with a slider inserted into the cavity.

FIG. 3 shows the arrangement of FIGS. 2(*a*) and (*b*) with the correspondingly arc-shaped slider 38 inserted into the cavity 36 to chock and retain the blade. More particularly, the blade root 30 is assembled into the disc slot 34 at bottom dead centre. The slider 38 is then slid (in a circular motion) into the cavity 36 formed between the disc 32 and root 30. This may require a degree of force as the blade is chocked against the root flanks. On the intake end of the slider 38, there is a stop formation 40 which abuts against a flat 42 formed within the slot 34 and/or the cavity to prevent further insertion of the slider. The stop formation 40 is illustrated in FIG. 3 as an integral part of the main body of the slider 38. Another option, however, is for the stop formation 40 to be formed of a damping material to further improve damping functionality and provide compliance in an over load case. It could also be made of a crushable material for the absorption of impact energy. The stop formation can be a separate component from the rest of the slider.

Figure 4:
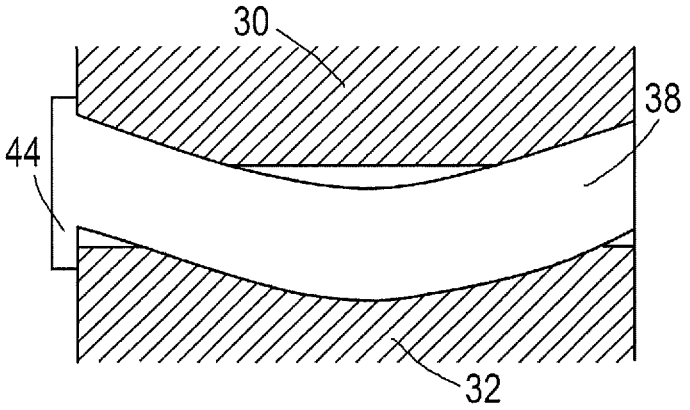
FIG. 4 shows the arrangement of FIGS. 2(*a*) and (*b*) with a variant of the slider inserted into the cavity 36.

FIG. 4 shows the arrangement of FIGS. 2(*a*) and (*b*) with a variant of the slider 38 inserted into the cavity 36. In the variant, instead of stop formation 40, the slider has a flange 44 which abuts an external face of the disc 32 and/or the root 30. The flange increases the overall axial length of the fan, but can assist with extraction of the slider.

The other end of the slider 38 can have rounded or chamfered end profile to facilitate insertion of the slider into the cavity 36.

The slider 38, by combining the chocking and axial retention functions, can reduce part count and cost. Further, the slider 38 can be contained within the envelope of the disc 32 and therefore does not require any extension to the disc, saving on forging and machining costs and reducing weight. The upper 36*a* and lower 36*b* portions of the cavity 36 are shallow and do not need to break the flanks of the blade root 30, making them particularly suited to a composite blade.

Figure 5A:
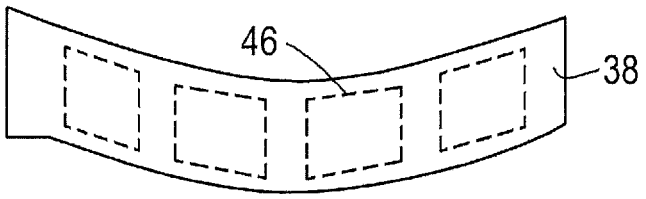
FIG. 5(*a*) shows a side view of a slider 38.
Figure 5B:
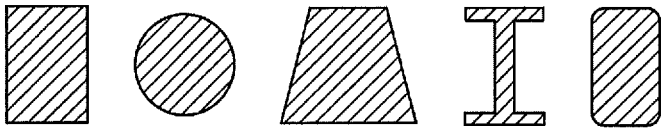

FIG. 5 shows (a) a side view of the slider 38, and (b) possible cross-sectional shapes for the slider (e.g. circular, rectilinear, I-section etc.), which can be configured for bending strength, weight and vibrational response and can optionally have one or more pockets 46 filled with damping material. Under extreme axial loading (such as a trailing blade impact or bird impact), impact energy can be dissipated through shear, bending and compressive forces between the slider 38, blade root 30 and the disc 32 rather than pure shear as with conventional retention plates. More particularly, due to the slider 38 the blade is constrained axially. Further, the blade is unable to rotate or rock against the slider as it is constrained by the dovetail root 30. Under an extreme axial load, the slider's shape translates some of the load into bending and axial compression as well as shear. This allows the absorption and dissipation some of impact energy over a larger volume and in more than one direction.

Figure 6:
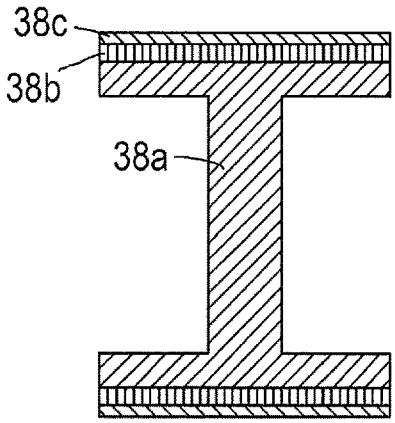
FIG. 6 shows a cross-section through a slider 38 having an I-section.

FIG. 6 shows a cross-section through a slider 38 having an I-section. The main body 38*a* of the slider can be formed of e.g. Ti alloy, Al alloy or steel. The top and/or bottom of the slider, however, can have a layer 38*b* of relatively compliant material, e.g. an elastomer such as Viton™, silicone etc. This can improve damping and impact protection, and take up any tolerance between the root 30, the disc 32 and the slider 38. On top of this layer can be a coating 38*c* of low friction material such as PTFE or Vespel™ to facilitate assembly and reduce fret wear. The blade root 30 in the upper portion(s) 36(*a*) of the cavity 36 can be similarly be lined to protect the root.

Figure 7A:
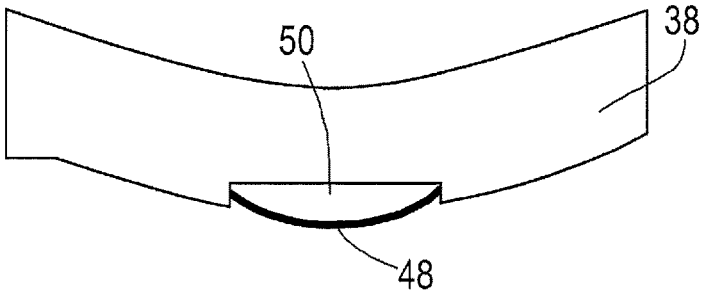
FIG. 7(*a*) shows a side view of a variant of the slider which has a chock spring.
Figure 7B:
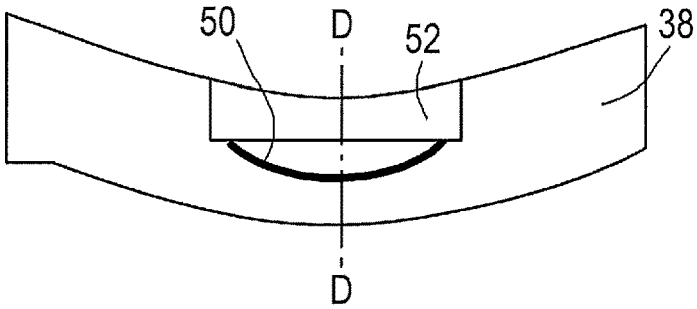
Figure 7C:
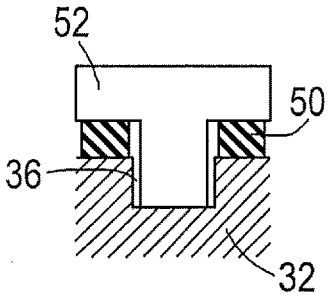

FIG. 7(*a*) shows a side view of a variant of the slider 38 which has a chock spring 48 located in a recess 50 formed on the radially inwards side of the slider. The chock spring can increase the force on the blade urging it radially outwardly. FIG. 7 also shows (b) a side view of a further variant of the slider, and (c) a cross-section on plane D-D through the further variant in use. The further variant has two chock springs 48 to either slide of the slider 38 mounted to the radially inwards sides of respective wings 52 which project from the sides of the slider. The springs 48 press against the disc 32 at the base of the slot 34 to either side of the cavity 36.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A rotor assembly of a gas turbine engine, the assembly comprising:

a disc;

a circumferential row of blades, each of the blades having a dovetail root which is retained in a corresponding axially-extending slot in a rim of the disc;

a circumferentially-extending row of axially-extending arc-shaped cavities, each of the cavities being formed in a base of a respective one of the dovetails roots and in the disc at a base of the corresponding axially-extending slot; and a circumferential row of correspondingly arc-shaped sliders, each of the arc-shaped sliders being slidingly inserted in a corresponding one of the axially-extending arc-shaped cavities, wherein each of the axially-extending arc-shaped cavities has at least one upper cavity portion formed in the respective one of the dovetail roots and at least one lower cavity portion formed in the disc at the base of the corresponding axially-extending slot.

2. The rotor assembly according to claim 1, wherein the normal to the plane of the arc of each of the axially-extending arc-shaped cavities is substantially perpendicular to the engine axis and to the radial direction.

3. The rotor assembly according to claim 1, wherein a concave side of each of the axially-extending arc-shaped cavities faces radially outwardly.

4. The rotor assembly according to claim 3, each of the axially-extending arc-shaped cavities has two upper cavity portions formed in ends of the root and a single lower cavity portion formed at a center of the base of the slot.

5. The rotor assembly according to claim 1, wherein a concave side of each of the axially-extending arc-shaped cavities faces radially inwardly.

6. The rotor assembly according to claim 5, each of the axially-extending arc-shaped cavities has two lower cavity portions formed in ends of the base of the slot and a single upper cavity portion formed at a center of the root.

7. The rotor assembly according to claim 1, wherein each of the arc-shaped sliders has a relatively compliant outer layer for enhanced contact of each of the arc-shaped sliders with the respective root.

8. The rotor assembly according to claim 1, wherein each of the arc-shaped sliders has a relatively compliant inner layer for enhanced contact of each of the arc-shaped sliders with the disc.

9. The rotor assembly according to claim 1, wherein each of the arc-shaped sliders has a low friction coating at the innermost and/or outermost surface thereof.

10. The rotor assembly according to claim 1, wherein each of the arc-shaped sliders has a stop at an end thereof which, in use, abuts a face of the disc or the root when the slider is fully inserted in the respective arc-shaped cavity to prevent over-insertion of the slider.

11. The rotor assembly according to claim 1, wherein each of the arc-shaped sliders contains one or more pockets filled with vibration damping material.

12. The rotor assembly according to claim 1, further comprising one or more chock springs which are arranged to act, in use, on the disc at the base of the slot to urge the blade radially outwardly.

13. A gas turbine engine including a rotor assembly, the rotor assembly comprising:

a disc;

a circumferential row of blades, each of the blades having a dovetail root which is retained in a corresponding axially-extending slot in a rim of the disc;

a circumferentially-extending row of axially-extending arc-shaped cavities, each of the cavities being formed in a base of a respective one of the dovetails roots and in the disc at a base of the corresponding axially-extending slot; and a circumferential row of correspondingly arc-shaped sliders, each of the arc-shaped sliders being slidingly inserted in a corresponding one of the axially-extending arc-shaped cavities, wherein each of the axially-extending arc-shaped cavities has at least one upper cavity portion formed in the respective one of the dovetail roots and at least one lower cavity portion formed in the disc at the base of the corresponding axially-extending slot.

14. The gas turbine engine according to claim 13, wherein the normal to the plane of the arc of each of the axially-extending arc-shaped cavities is substantially perpendicular to the engine axis and to the radial direction.

15. The gas turbine engine according to claim 13, wherein a concave side of each of the axially-extending arc-shaped cavities faces radially outwardly.

16. The gas turbine engine according to claim 15, each of the axially-extending arc-shaped cavities has two upper cavity portions formed in ends of the root and a single lower cavity portion formed at a center of the base of the slot.

17. The gas turbine engine according to claim 13, wherein a concave side of each of the axially-extending arc-shaped cavities faces radially inwardly.

18. The gas turbine engine according to claim 17, each of the axially-extending arc-shaped cavities has two lower cavity portions formed in ends of the base of the slot and a single upper cavity portion formed at a center of the root.

* * * * *